United States Patent [19]

Caruso

[11] 4,408,188

[45] Oct. 4, 1983

[54] ELECTROMECHANICAL DECODER

[75] Inventor: Peter J. Caruso, Wayne, N.J.

[73] Assignee: The Bendix Corporation, Teterboro, N.J.

[21] Appl. No.: 306,792

[22] Filed: Sep. 5, 1963

[51] Int. Cl.[3] ..... G08C 11/00

[52] U.S. Cl. ..... 340/345; 74/149; 74/155; 192/67 R

[58] Field of Search ..... 74/149, 155; 192/71, 192/67, 96, 67 R; 340/167, 357, 358, 365, 345, 365 R

[56] References Cited

U.S. PATENT DOCUMENTS

| | | | |
|---|---|---|---|
| 403,356 | 5/1889 | Manton | 192/71 |
| 1,118,456 | 11/1914 | Wilkin | 192/71 |
| 2,039,966 | 5/1936 | Lockhart et al. | 340/164 A |
| 2,452,052 | 10/1948 | Hibbard | 177/353 |
| 2,503,402 | 4/1950 | McDavitt et al. | 340/164 A |
| 2,568,264 | 9/1951 | Zenner | 340/164 A |
| 2,595,616 | 5/1952 | Stickel | 177/353 |
| 2,794,969 | 6/1957 | Barnhart | 340/164 |
| 2,905,936 | 9/1959 | Gossard | 340/164 A X |
| 2,947,974 | 8/1960 | Stickel | 340/164 |
| 2,968,790 | 1/1961 | Carbonara | 340/164 |
| 3,013,248 | 12/1961 | Carbonara et al. | 340/164 |
| 3,074,051 | 1/1963 | Penningroth | 340/164 |

*Primary Examiner*—Stephen C. Bentley

*Attorney, Agent, or Firm*—Anthony F. Cuoco; Vett Parsigian

EXEMPLARY CLAIM

1. An electromagnetic decoder comprising a code wheel assembly including a base member, a shaft supported by the base member, a first wheel element and a second wheel element carried by the shaft, a plurality of code posts carried by the first wheel element and preset for locking the first and second wheel elements together in driving relation, selectively operable means carried by the base member for actuating the code posts sequentially in a predetermined sense for unlocking the first and second wheel elements, and means actuated by one of the wheel elements for performing a control function upon the first wheel element being unlocked from the second wheel element.

28 Claims, 10 Drawing Figures

ELECTROMECHANICAL DECODER

This invention relates to an electromechanical decoder and more particularly to a decoder mechanism for use in applications where a maximum of safety and security is necessary for the performance of unique functions as in a launch controlling system for missiles.

An object of the invention is to provide an electromechanical decoder including a preset code locking means so arranged that a complimentary or identical code input must be applied in order to unlock the device and means whereby once the device has been unlocked, the performance of an end function such as switch closure may readily take place.

Another object of the invention is to provide a drive for the aforenoted device including a pair of solenoids so arranged that each time one of the solenoids is selectively actuated, a code wheel assembly is step actuated while a series of code posts carried thereby are selectively actuated in locking or unlocking senses depending on the selection of the solenoid and preset adjustment of the code post.

Another object of the invention is to provide in an electromechanical decoder of the aforenoted type, spring means whereby energy applied by the stepping action of the solenoids may be stored for effecting a reset adjustment of the decoder.

Another object of the invention is to provide in the aforenoted electromechanical decoder a stepping arrangement including a ratchet wheel and a pair of actuating pawls cooperating therewith and controlled by the stepping solenoids, the arrangement being such that a selectively energized actuating solenoid may condition one of the pawls for operation while the other pawl maintains the ratchet wheel and thereby the code wheel assembly in a fixed position until de-energization of the selected actuating solenoid renders an operatively conditioned spring effective to operate the one pawl to step the ratchet wheel and thereby the code wheel assembly to a second adjusted position under the biasing force of suitable actuating spring means.

Another object of the invention is to provide in an electromechanical decoder a code wheel assembly so arranged that selective energization of the actuating solenoid to unlock the code wheel assembly cannot be discerned either electrically or audibly during the application of the coding signals.

Another object of the invention is to provide in an electromechanical decoder suitable means for applying a plurality of decoding bits which may be stored therein and which may be effective to cause the release of an inner wheel from locking relation with an outer wheel of the code wheel assembly so that closure of a switch controlled by the outer wheel may be effected upon the application thereto of a plurality of code bits in the proper sense and an arrangement in which there is provided means whereby if any or all of the code bits are improperly applied, the outer wheel may remain locked to the inner wheel so that the outer wheel may not be adjustably positioned to complete the decoding action or closure of the controlled switch.

Another object of the invention is to provide an electromechanical decoder including a plurality of code posts which may be readily adjusted to change the setting of the code for unlocking the decoder.

Another object of the invention is to provide an electromechanical decoder arranged to accept a serial code input and so arranged as not to interrogate each code input as received, but rather including means whereby the received code inputs may be stored and read out in parallel when the final unlocking code input is applied.

Another object of the invention is to provide an electromechanical decoder including means whereby audible noise masking may be effected so that in the placing of a "proper" or "improper" code bit in the unit requires the same amount of work at each station, and thus the code may not be discerned by monitoring audible sounds.

Another object of the invention is to provide an electromechanical decoding device in which the amount of work done in applying any one code bit is exactly the same whether the code bit is "proper" or "improper" while the electrical emanations of the selectively actuated solenoids remain the same under all operating conditions so that the applicable code may not be discerned or deduced by monitoring the electrical emanations of the two selectively operated driver solenoids.

Another object of the invention is to provide in the aforenoted electromechanical decoder a code wheel assembly including a inner wheel and an outer wheel lying concentrically on a main shaft and free to rotate in relation thereto and in which the inner wheel is prevented from rotating beyond a predetermined position by a protruding arm which bottoms to the base structure of the mechanism and in which code wheel assembly there is provide a plurality of code posts preset to lock or unlock the inner wheel relative to the outer wheel dependent upon the selective actuation thereof so that if the code posts had been properly actuated in a predetermined order in accordance with a preset code, the inner and outer wheels will be disengaged and the outer wheel will be permitted to advance to a position for closing a switch controlled thereby for effecting the desired control function, and in which arrangement, should any or all of the code bits be incorrect, the wheels will not be disengaged and one or another of the code posts as actuated by the incorrect code bits will be effective to connect the one wheel to the other wheel so that the stopping of movement of the inner wheel will also prevent the outer wheel from operating to close the control switch.

Another object of the invention is to provide novel means in the aforenoted electromechanical decoder whereby upon the inner wheel being stopped from rotation and the outer wheel being locked thereto, the operation of an automatic reset mechanism may be initiated so as to cause the return of the code wheel assembly to an initial home or start position.

Another object of the invention is to provide in the code wheel assembly a plurality of code posts for locking the inner and outer wheels and which code posts may be preset to represent a series of digital 1 or 0 bits and in which arrangement each code post may be set for either a 1 or 0 bit by merely rotating the code posts to either of two positions, each 180° away from the other and held in such position by spring loaded detents.

Another object of the invention is to provide an electromechanical decoder in which solenoid, electrical, and audible noise masking may be effected by providing novel means whereby code input information may be stored irrespective of whether each code post has been properly actuated.

Another object of the invention is to provide an electromechanical decoder in which the work expended to move any code post is normally the same whether actuated by one or the other of the selectively operated solenoids.

Another object of the invention is to provide an electromechanical decoder in which electrical emanations of the selectively operable decoding solenoids while not actually masked or eliminated has no effect on the security thereof, when considered in relation to code deduction possibilities, since whatever audible noise may be generated during decoding will be always the same for each code post position so that the monitoring of the audible noise will yield no code deduction information.

Another object of the invention is to provide an electromechanical decoder in which once a code wheel is moved off a home position, a reset mechanism will be conditioned for selective operation to return the code wheel to the home position.

Another object of the invention is to provide an electromechanical decoder including means to reset the decoder mechanism to a home position by lifting the two driver pawls from an operative position so as to render effective an energy restore spring means to return the code wheel assembly to a safe, null, or home position.

Another object of the invention is to provide novel means for initiating the aforenoted reset action of the code wheel assembly by providing an automatic reset mechanism controlled through an internal mechanical linkage powered by the stepping springs so as to act to lift the actuating pawls for return of the code wheel assembly upon receipt of an improper code message.

Another object of the invention is to provide an electrically operated reset solenoid to lift the actuating pawls for return of the code wheel assembly to a start position.

Another object of the invention is to provide novel means including a command reset solenoid and an automatic reset means either of which may be effective to lift the actuating pawls so that the code wheel assembly may be returned to a home position.

Another object of the invention is to provide in an electromechanical decoder a novel automatic reset mechanism effective upon receipt of an incorrect code bit to return the code wheel assembly to a home position after receipt of the last code bit of the complete code message.

These and other objects and features of the invention are pointed out in the following description in terms of the embodiment thereof which is shown in the accompanying drawings. It is to be understood, however, that the drawings are for the purpose of illustration only and are not a definition of the limits of the invention. Reference is to be had to the appended claims for this purpose.

In the Drawings

Figure 2:
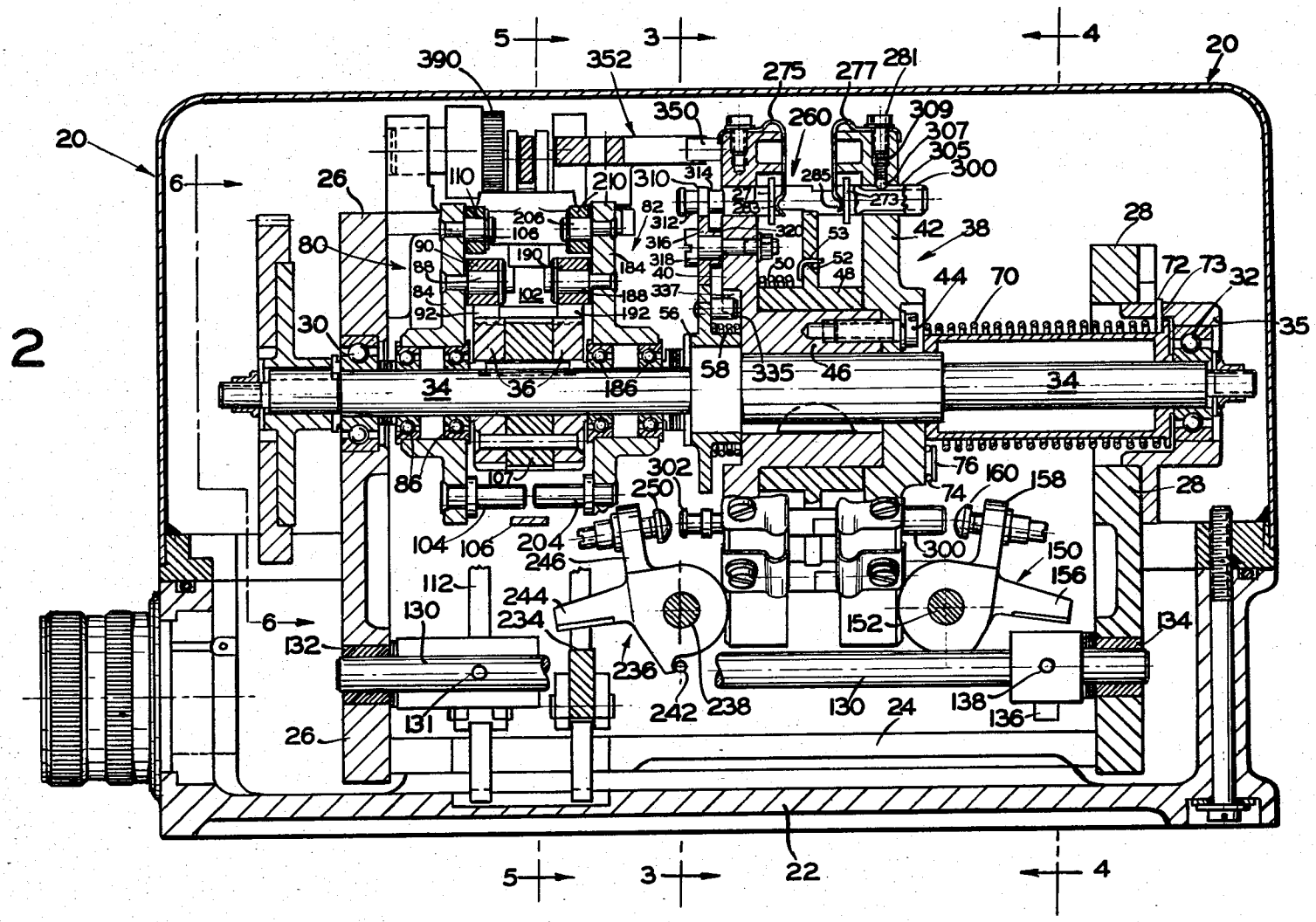
FIG. 2 is a side assembly view of the decoder mechanism embodying the invention with certain parts broken away and shown in section.

Referring to the drawing of FIG. 2, a decoder mechanism is shown housed in a casing 20 having a base 22 to which may be fastened a base plate 24. There may project from the base plate 24 end plates 26 and 28 in which there may be rotatably mounted a shaft 34 on roller bearings 30 carried by end plate 26 and roller bearings 32 carried by a member 35 fastened in the end plate 28. The decoder shaft 34 has secured thereto a rachet wheel 36 and a code wheel assembly 38.

Figure 1:
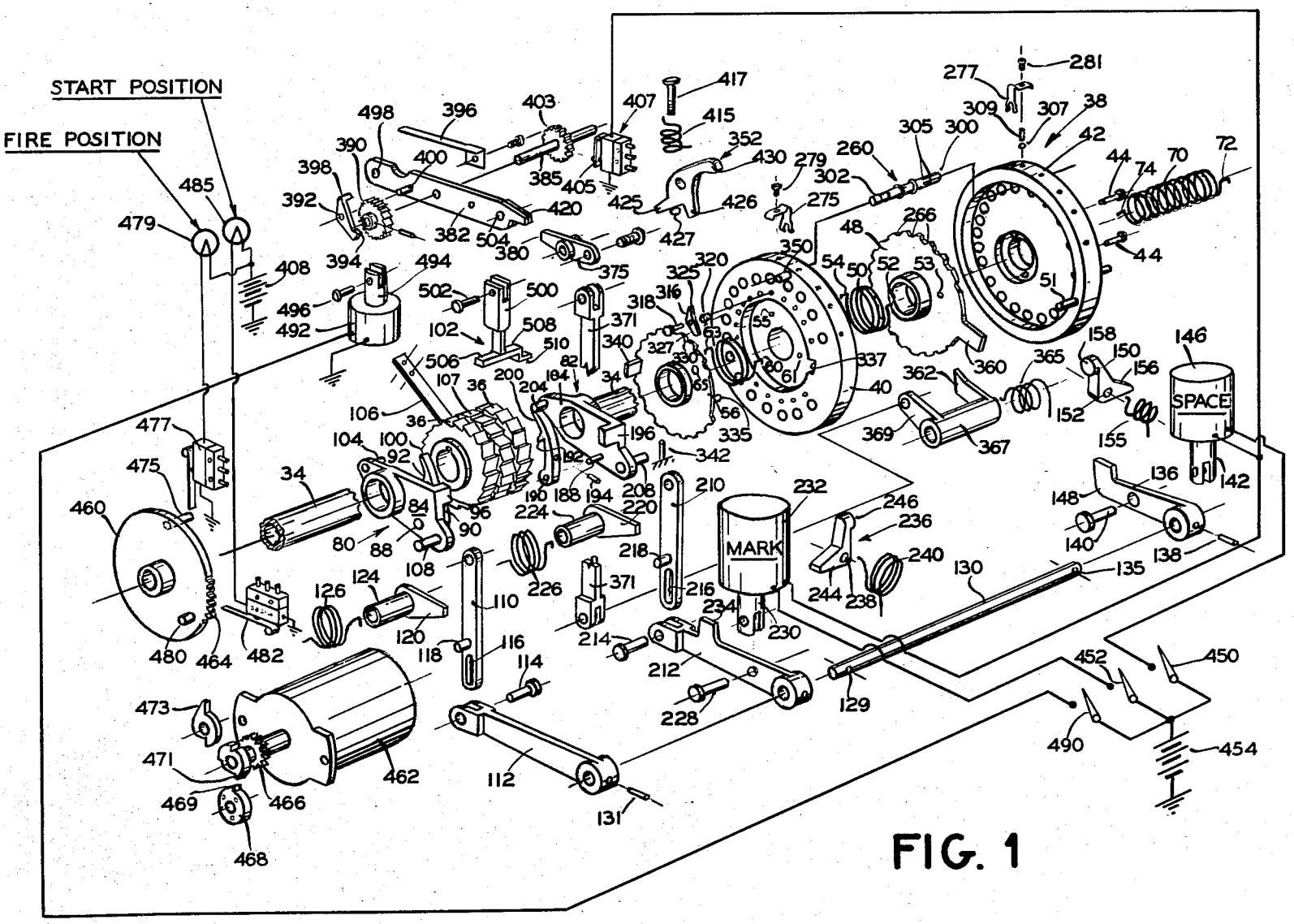
FIG. 1 is an exploded detail schematic diagram of an electromechanical decoder embodying the invention.

The code wheel assembly 38, as shown in FIGS. 1 and 2, includes outer wheel elements 40 and 42 which are fastened one to the other by bolts 44 mounted in the outer wheel element 42 and screw threadedly engaged in a hub portion 46 of the outer wheel element 40. Angularly movable on the hub portion 46 is an inner wheel element 48 operatively connected to the outer wheel element 40 by a light coupling spring 50 connected at one end 52 to the inner wheel element 48 at 43 and at the opposite end 54 at 55 to the outer wheel element 40. There projects from the inner wheel element 48 an arm 360 normally biased by the preload of the coupling spring 50 in a clockwise direction against a stop pin projecting from the outer wheel element 42.

Further, rotatably mounted on the shaft 34 and positioned adjacent the outer wheel element 40 is a reset wheel 56 operatively connected to the outer wheel element 40 by coupling spring 58 connected at one end 60 in a hole 61 in the outer wheel element 40 and connected at an opposite end 63 in a hole 65 formed in the reset wheel 56.

There projects from the reset wheel 56 a pin 335 positioned in a slot 337 in the outer wheel element 40 and biased by the coupling spring 58 in a counterclockwise direction against a stop portion of the slot 337.

A reset spring 70 is coiled about the shaft 34 and has one end 72 secured at 73 in the member 35 fastened to the end plate 28 and an opposite end portion 74 secured to the wheel 42 by a bolt 76.

Pawl Actuating Mechanism

Further cooperating with the code wheel assembly 38 adjustably positioned by the shaft 34 are pawl actuating mechanisms indicated generally by the numerals 80 and 82. The pawl actuating mechanism 80 includes a pawl supporting member 84 angularly movable on bearings 86 carried by the shaft 34. The pawl supporting member 84 has pivotally connected thereto a pin 88, a pawl 90 having a tooth 92 biased into operative engagement with the teeth of the ratchet wheel 36 by a spring, not shown, but similar to spring 194 of FIG. 5 and positioned between the pawl 90 and arm 96 projecting from the member 84. The pawl 90 has an end portion 100 arranged to be operatively engaged by a pawl lift or pick-up device 102, shown in FIGS. 1 and 5, and hereinafter explained.

Figure 5:
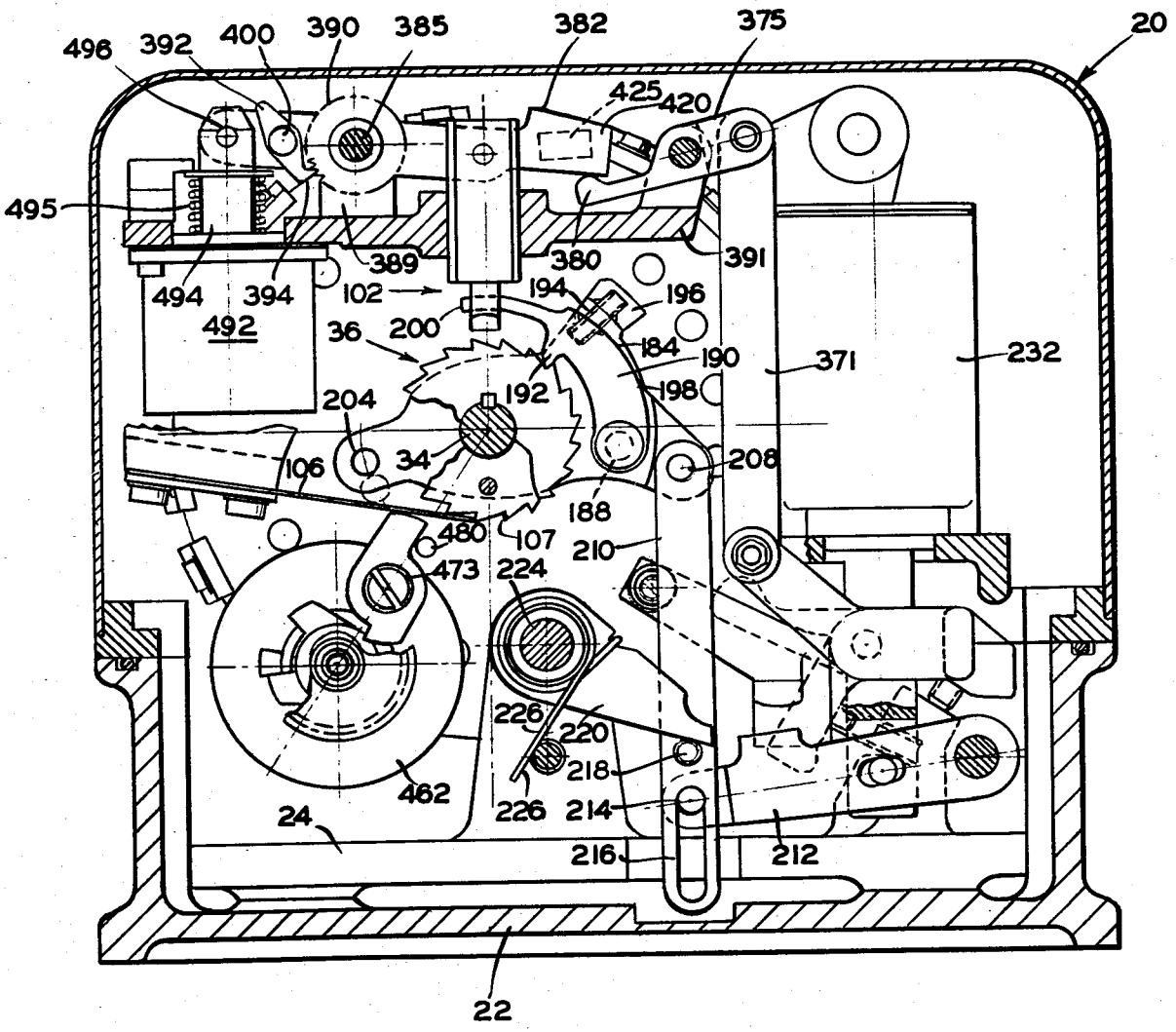
FIG. 5 is a sectional view of FIG. 2 taken along the lines 5—5 and looking in the direction of the arrows.

The pawl supporting member 84 has a pin 104 at one end so positioned as to cooperatively engage a leaf spring 106 normally engaging teeth of an antiadvance ratchet 107, shown in FIGS. 2 and 5. The pin 104 is arranged to remove spring 106 from engaging relation with teeth of ratchet 107 prior to advance of ratchet wheel 36 by pawl 90. The opposite end of the pawl supporting member 84 has operatively connected thereto by a pin 108 an actuating linkage 110 operatively connected at an opposite end to an arm 112 through a pin 114 carried by the arm 112 and slidably positioned in a slot 116 in the opposite end of the link 110. A pin 118 projects from the link 110 and is operatively engaged by an arm 120 carried by a pin 124 and biased by a code wheel advance spring 126 into cooperating engagement with the pin 118.

The arm 112 is operatively connected at 129 to a shaft 130 by a pin 131. The shaft 130 is rotatably mounted at one end in a bearing 132 carried by the end plate 26 while the opposite end of the shaft 130 is rotatably mounted in a bearing 134 carried by the end plate 28. Further, operatively connected to the shaft 130 at 135 is an arm 136 connected thereto by a pin 138. Connected to the arm 136 by a pin 140 is a rod 142 actuated by a solenoid 146.

Further, the arm 136 has an end portion 148 arranged to operatively engage a knocker arm 150, pivotally mounted on a pin 152 carried by a flange projecting from the base 24. The knocker arm 150 is biased by a spring 155 so as to maintain an end portion 156 thereof in operative engagement with the end portion 148 of the arm 136 while another end portion 158 of the knocker arm 150 has screw threadedly engaged therein a knocker bolt 160 having a head portion which may be actuated by the end portion 158 into operative engagement with end portions of slidable code posts carried by the outer wheel elements 40 and 42 of the code wheel assembly 38, as hereinafter explained.

Further, the pawl actuating mechanism 82 includes a pawl supporting member 194 angularly movable on bearings 186 carried by the shaft 34. The pawl supporting member 184 has pivotally connected thereto by a pin 188, a pawl 190 having a tooth 192 biased into operating engagement with the teeth of the ratchet wheel 36 by a spring 194, shown in FIG. 5, and positioned between the pawl 190 and arm 196 projecting from the member 184. The pawl 190 has an end portion 200 arranged to be operatively engaged by the pawl lift device 102, shown in FIGS. 1 and 5, and hereinafter explained.

The pawl supporting member 184 has a pin 204 at one end so positioned as to cooperatively engage the leaf spring 106 to remove the same from engaging relation with teeth of the antiadvance ratchet 107 prior to advance of ratchet wheel 36 by pawl 190. The opposite end of the pawl supporting member 184 has operatively connected thereby by a pin 208 an actuating linkage 210 operatively connected at an opposite end to an arm 212 through a pin 214 carried by the arm 212 and slidably positioned in a slot 216 in the opposite end of the link 210. A pin 218 projects from the link 210 and is engaged by an arm 220 carried by a pin 224 and biased by a code wheel advance spring 226 into cooperative engagement with the pin 218.

The arm 212 is angularly movable on the shaft 130 and has operably connected thereto by a pin 228 a rod 230 actuated by a solenoid 232, and further, there projects from the arm 212 a portion 234 arranged to operatively contact a knocker arm 236 pivotally mounted on a pin 238 carried by a flange projecting from the base plate 24. The knocker arm 236 is biased by a spring 240 so as to maintain an end portion 244 thereof in operative engagement with the portion 234 of the arm 212 while another portion 246 of the knocker arm 236 has screw threadedly engaged therein a knocker bolt 250 having a head portion which may be actuated by the portion 234 of the arm 212 into operative engagement with the slidable code posts 260 carried by the outer wheel elements 40 and 42 of the code wheel assembly 38, as hereinafter explained.

Code Wheel Assembly

Figure 10:
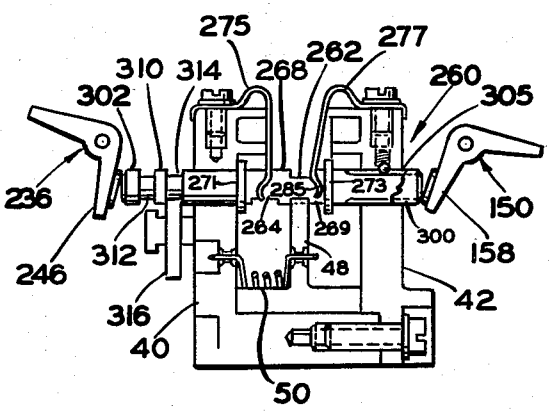
FIG. 10 is a view of the fragmentary code wheel assembly of FIG. 8 with the code post adjusted from a neutral position to a locking position relative to the code wheel assembly as upon receipt of an improper code bit.
Figure 9:
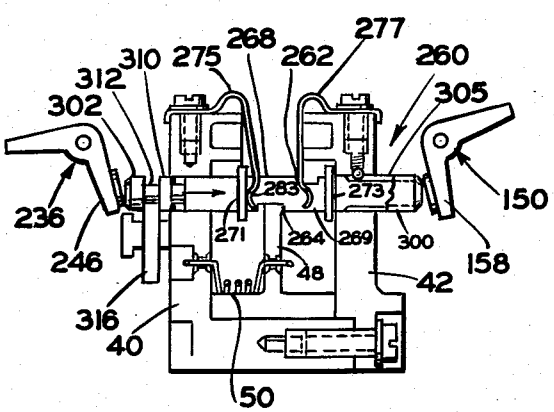
FIG. 9 is a view of the fragmentary code wheel assembly of FIG. 8 with the code post adjusted from a neutral position to an unlocking position relative to the code wheel assembly as upon receipt of a proper code bit.
Figure 8:
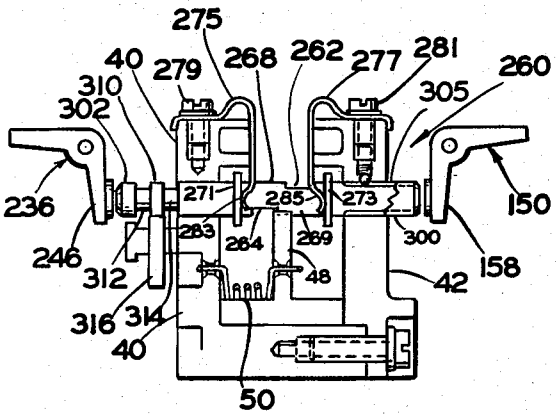
FIG. 8 is a partial fragmentary sectional view of the decoder wheel of FIG. 2 and showing a code post in a neutral position.

The code wheel assembly 38, shown in FIGS. 1, 2, 3, and 4, includes a plurality of locking code posts 260 slidably mounted in the outer wheel elements 40 and 42. Each of the code posts 260, as shown in FIGS. 8, 9, and 10 have indented portions 262 and 264 positioned in the post intermediate the opposite ends thereof and arranged in spaced relation 180° apart. The indented portions 262 and 264 may be selectively positioned so as to so cooperate with the inner wheel element 48 as to permit the inner wheel element 48 upon adjustment of the post 260 in one sense, as shown in FIG. 9, to move free of the outer wheel elements 40 and 42 against the light biasing force of the coupling spring 50.

The inner wheel element 48, as best shown in FIG. 1, includes indent portions 266 arranged to cooperate with raised portions 268 and 269 of the post 260 to lock the inner wheel 48 in operative relation with the outer wheel elements 40 and 42, as shown for example, in FIGS. 8 and 10, upon the code post 260 being adjusted in a neutral position or in a position opposite from that shown in FIG. 9.

The code post 260 further includes flange portions 271 and 273 mounted in spaced relation thereon and arranged to be engaged by release spring elements 275 and 277 secured at one end by bolts 279 and 281 to the outer wheel elements 40 and 42 and having opposite end portions 283 and 285 bearing on the flange portions 271 and 273 so as to normally bias the code post 260 to the neutral position, shown in FIGS. 2 and 8.

However, upon actuation of the code post 260 in one sense, as shown for example in FIG. 9, against the biasing force of spring 275, the code post will be adjusted so as to position the indent portion 264 immediately adjacent the outer periphery of the inner wheel 48 so as to release the same from a locking position relative to the outer wheels 40 and 42 and thereupon the outer diameter of the inner wheel 48 is permitted to pass the code post at the indent portion. Conversely, upon actuation of the code post 260 in an opposite sense against the biasing force of the spring 277, the code post may be positioned away from the indent portion 264 whereupon the raised portion 269 of the code post 260 is adjustably positioned in the indent portion 266 of the inner wheel element 48 and in locking relation with the inner wheel element 48, as shown for example, in FIG. 10, whereupon the outer diameter of the inner wheel is not permitted to pass the code post.

The code post 260 may be manually rotated 180° so as to change the operative relation described and bring the indent portion 262 into operative relation upon actuation of the code post 260 to the position shown by FIG. 10, while the raised portion 268 is then effective to lock the inner wheel element 48 and outer wheel elements 40 and 42 upon actuation of the code post 260 to the opposite position shown by FIG. 9.

The actuation of the code posts 260 in the one and other senses described in reference to FIGS. 9 and 10 may be selectively effected by the knocker arms 150, as shown in FIG. 10, and the knocker arm 236, as shown in FIG. 9, and the code wheel assembly 38 may be rotated in a step action by the pawl actuating mechanism 80 and 82 in operative relation with the ratchet wheel 36.

Selective energization of the solenoids 146 and 232 control respectively the knocker arms 150 and 236 and the tension applied to the code wheel advance springs 126 and 226. While upon de-energization of the selected solenoid 146 or 232, as the case may be, the energy stored in the code wheel advance spring becomes effective to actuate the pawl actuating mechanism (80 or 82) and thereby the rachet wheel 36 to move the code wheel 38 to the next succeeding position with a step action.

In the step actuation of the ratchet wheel 36, the energization of the selected solenoid (146 or 232) conditions the pawl (90 or 190) controlled thereby for operation relative to the ratchet wheel 36 while the other pawl maintains the ratchet wheel 36 and thereby the code wheel assembly 38 in a fixed position until de-energization of the selected solenoid renders the tensioned code wheel advance spring (126 or 226) effective to cause the controlled pawl to actuate the code wheel assembly 38 to the next succeeding position for effecting successive operation of the several code posts 260, as hereinafter described in greater detail.

Figure 3:
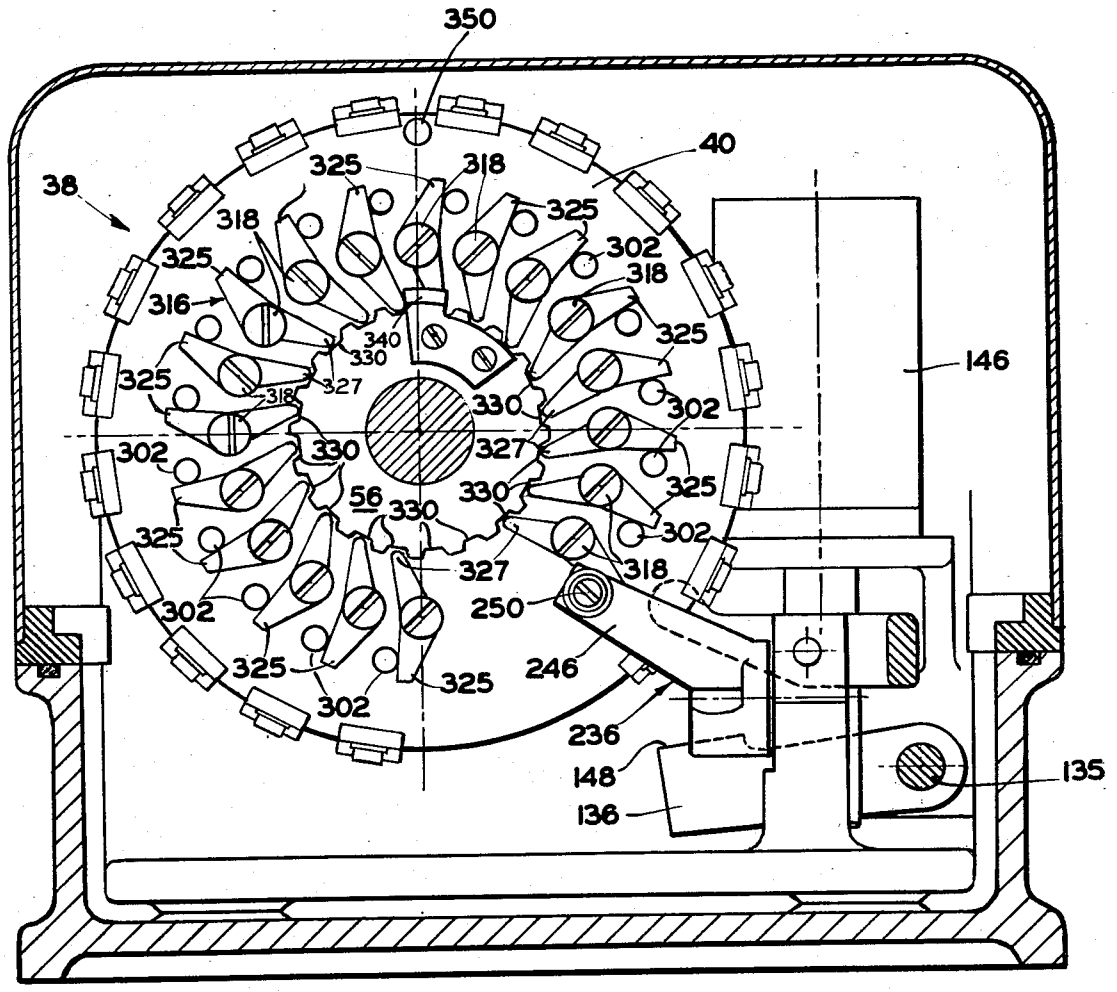
FIG. 3 is a sectional view of FIG. 2 taken along the lines 3—3 and looking in the direction of the arrows.
Figure 4:
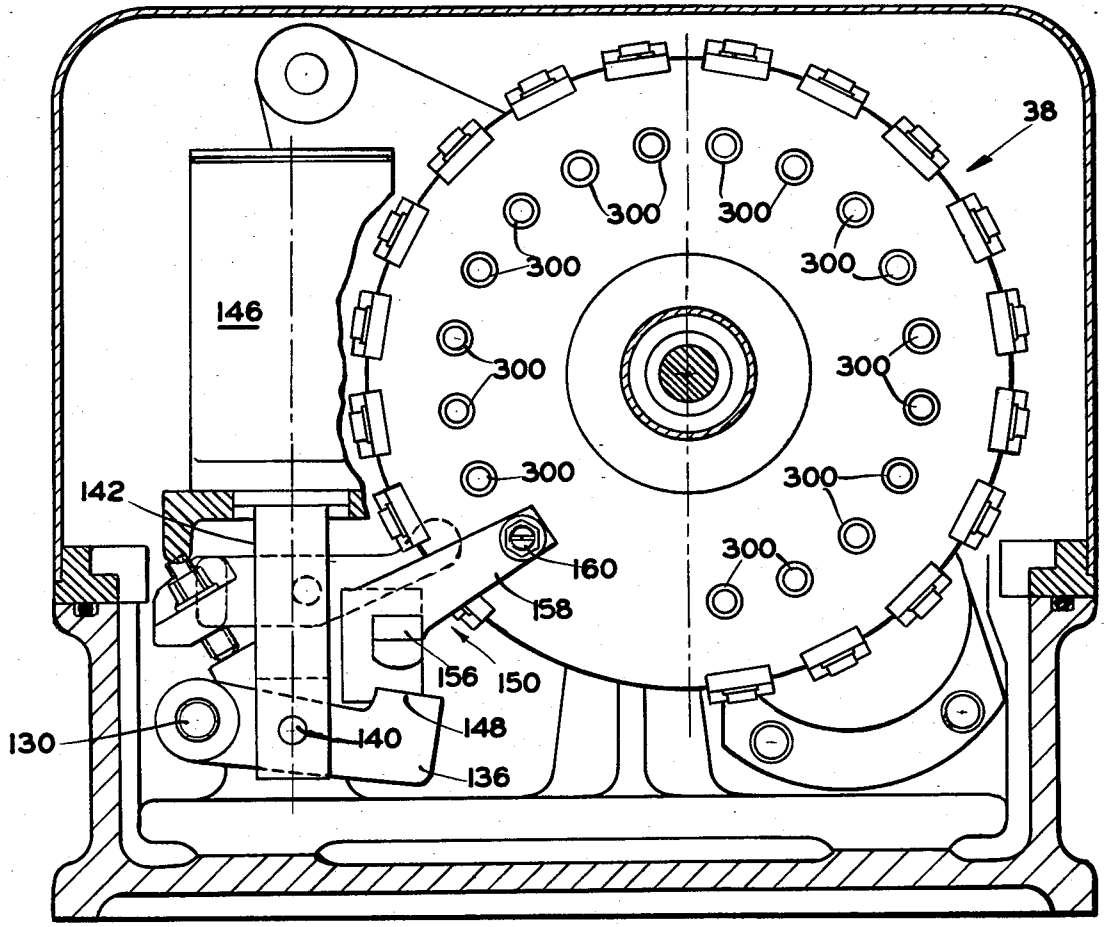
FIG. 4 is a sectional view of FIG. 2 taken along the lines 4—4 and looking in the direction of the arrows.

Further, each of the code posts 260 includes an end portion 300 protruding from the outer wheel element 42 and arranged for selective operation by the end portion 158 of the knocker arm 150 through the knocker bolt 160, as shown in FIGS. 4 and 10, while the opposite end of the code post 260 includes an end portion 302 protruding from the outer wheel element 40 and arranged for actuation by the end portion 246 of the knocker arm 236 through the knocker bolt 250, as shown in FIGS. 3 and 9.

In the end portion 300 of the code post 260, there are arranged longitudinal slots 305, as possibly best shown in FIGS. 1 and 2. Cooperating with the slots 305 is a ball detent 307 biased by a spring 309 held by the bolt 281 so as to releasably resist angular rotation of the post 260 and thereby maintain the same in an angularly adjusted position in the outer wheel elements 40 and 42.

Further, at the opposite end portion 302 of the code post 260, there is provided a flange portion 310 and indent portions 312 and 314 arranged in spaced relation at opposite sides of the flange portions 310 so as to cooperate with a locking detent member 316 upon actuation of the code post 260 in one or the other of the senses illustrated in FIGS. 9 and 10.

Each of the locking detents 316, as shown in FIG. 3, are pivotally mounted by a bolt 318 on the outer surface of the outer wheel element 40 and are biased by a spring 320 so as to bring the end portion 325 thereof into cooperative engagement with the indent portion 312 or 314, as the case may be, upon actuation of the post 260 from the neutral position, shown in FIG. 8, to one or the other of the positions illustrated in FIGS. 9 and 10. The opposite end portion 327 of the detent 316 is positioned in a recess 330 formed in the periphery of the reset wheel 56, as shown in FIGS. 1 and 3.

The reset wheel 56, as shown in FIGS. 1 and 2, has the pin 335 projecting from the inner surface thereof into the slot 337 provided in the outer wheel element 40 and arranged so as to limit the angular movement of the reset wheel 56 relative to the outer wheel 40. Further, there projects from the opposite side of the reset wheel 56 an arm 340 cooperatively arranged in relation to the pawl liftup device 102 and a stop 342 carried by the base 24 of the unit, as hereinafter explained.

Figure 7:
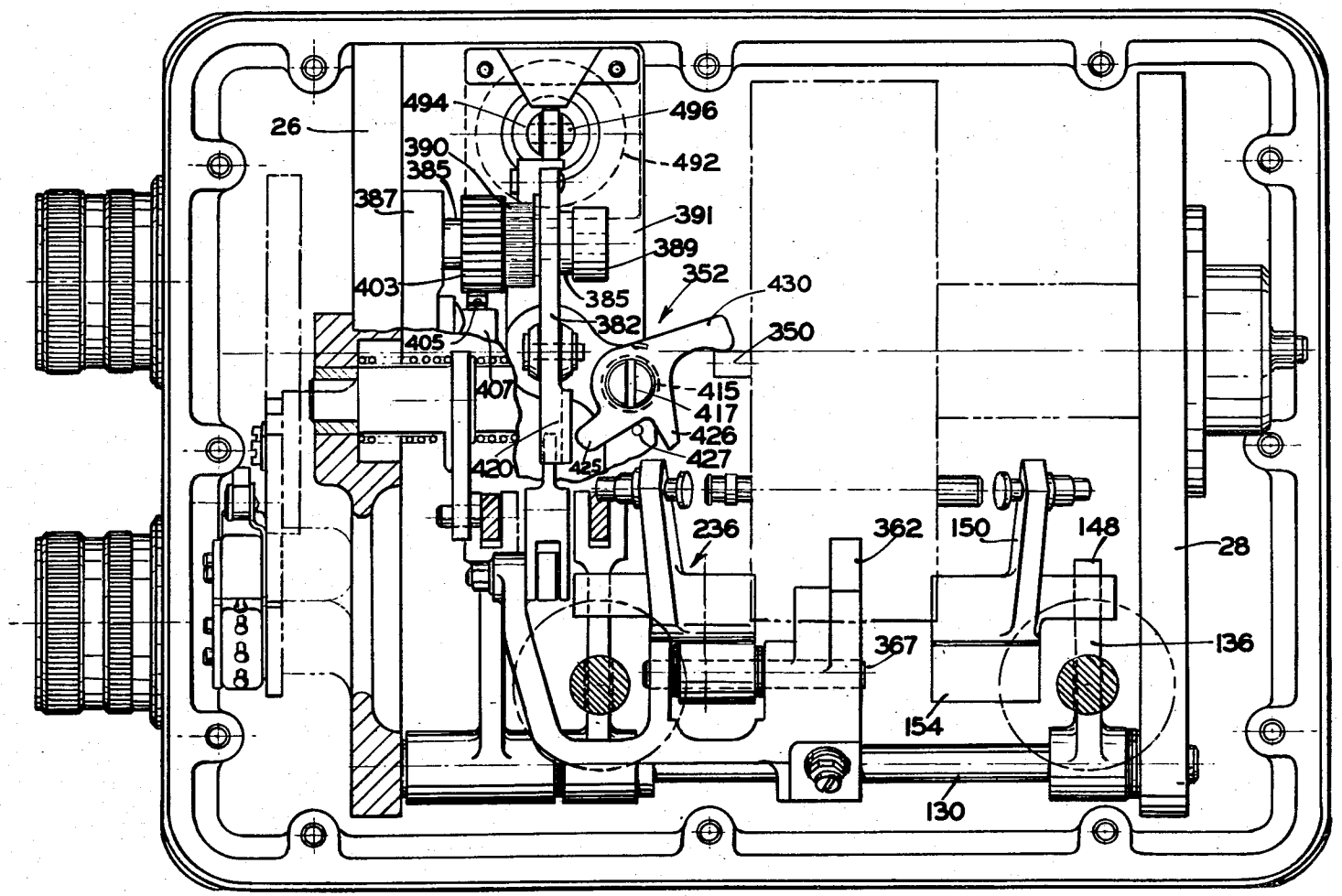
FIG. 7 is an elevational view of the decoder mechanism with the cover removed and certain of the parts partially broken away to better show the structure of the mechanism.

Further, as shown in FIGS. 1, 3, and 7, a pin 350 projects from the outer wheel element 40 in cooperative relation with a releasable latching mechanism 352 for effecting operation of the pawl lift or pick-up device 102, as hereinafter explained.

As shown in FIG. 1, there projects from the inner wheel element 48, an arm 360 arranged to operatively engage an arm 362 of an automatic reset mechanism upon the outer wheel elements 40 and 42 remaining in locked relation with the inner wheel element 48 following receipt of a faulty decoding message, the latter action causing the arm 362 to be actuated by the arm 360 under the biasing force of spring 126 of pawl 90 or spring 226 of pawl 190. The arm 362 being actuated in a counterclockwise direction, as viewed in FIG. 1, against the lesser opposing biasing force of a spring 365 acting about a pivot shaft 367, causing an arm 369 to actuate through an interconnecting link 371, an actuating arm 375, in a clockwise direction, as viewed in FIGS. 1 and 5, whereupon the actuating arm 375 actuates end portion 380 thereof into operative engagement with a reset lever 382 so as to pivot the lever 382 in a counterclockwise direction against the biasing force of a spring 495, shown in FIG. 5, and about a shaft 385 carried by flange portions 387 and 389 projecting from the end plate 26 and a plate 391 carried by the end plate 26, as shown by FIG. 7.

The actuation of the reset lever 382 about the shaft 385 in a counterclockwise direction causes a ratchet wheel 390 secured to the shaft 385 to impart a rotary movement to the shaft 385 due to the action of a pawl 392 having a tooth portion 384, which, upon such counterclockwise rotation of the reset lever 382 engages a tooth of the ratchet wheel 390 under the biasing force of a leaf spring 396 bearing on an end portion 398 of the pawl 392 so as to bias the pawl 392 about a pin 400 carried by the reset lever 382 and thereby impart arcuate movement to the shaft 385, which has operatively connected thereto a gear 403, shown in FIG. 1, to thereupon actuate a buttom 405 of a suitable switch mechanism 407 to interrupt a ground circuit from a battery 454 to both of the actuating solenoids 146 and 232.

Further, the actuation of the reset lever 382 angularly about the shaft 385 permits a releasable latching mechanism 352 to be biased into latching relation with and immediately below an end portion of the reset lever 382 so as to hold the lever in the reset position. The latching mechanism 352, as shown in FIG. 7, is biased by a spring 415 in a clockwise direction about a pivot pin 417 into engaging relation with an end portion 420 of the reset lever 382. Thus, upon the reset lever 382 being raised by the action of the arm 375, an end portion 425 of the latching device 352 is biased immediately below the end portion 420 of the lever 382 while the end portion 426 of the latch 352 is limited in the clockwise direction by a pin 427 carried by the plate 391.

In the operation of the pick-up device 102, it may be noted that the pick-up device 102 is actuated into operative relation with the pawls 90 and 190 under the biasing force of the effective code wheel advance spring (126 or 226) acting on the actuating pawl (90 or 190) driving the shaft 34 and code wheel assembly 38 in a clockwise direction, as viewed in FIG. 1. This action causes the arm 360 to operatively engage the reset arm 362 to actuate the reset linkage 369, 371, and 380 against the lesser opposing biasing force of the spring 365 so as to actuate lever 382 in a counterclockwise direction lifting rod 500 and portions 506 and 508 of the pick-up device 102 into engagement with the end portions 100 and 200, respectively, of the pawls 90 and 190.

In this action, the pick-up device 102 lifts the retracted pawl (90 or 190) from the engaging teeth of the ratchet wheel 36 while the driving pawl (90 or 190) may continue in driving relation with the teeth of the ratchet wheel 36 until the latching mechanism 352 under the force of spring 415 has moved into latching relation with the end portion 420 of the lever 382. Thereafter, as the driving pawl (90 or 190) under the biasing force of the code wheel advance spring (126 or 226) acting on the pawl actuating mechanism (80 or 82) is pivoted about the shaft 34, the tooth (92 or 192) of the driving pawl (90 or 190) is held by the pick-up device 102 from following in driving relation with the engaging tooth of the ratchet wheel 36. Thereupon, as the pawl actuating mechanism (80 or 82) continues to pivot about the shaft 34 under the force of the code wheel advance spring (126 or 226), the pick-up device 102 held in operative relation by the latching mechanism 352 and acting in cooperation with the pawl actuating mechanism in effect lifts the driving pawl out of engaging relation with the receding engaging tooth of the ratchet wheel 36, as the ratchet wheel turns under the force of the driving pawl. This disengaging action may be effected at, for example, 5° of travel of the code wheel assembly 38 as compared with an 18° of code wheel travel between each code post position normally effected by the driving pawl in acting on the ratchet wheel 36.

Upon the driving pawl disengaging the ratchet wheel 36, the pawl actuating mechanism continues to pivot about the shaft 34 for the full angle of driving motion imparted by the code wheel advance spring (126 or 226) while the return spring 70 on disengagement of the driving pawl (90 or 190) from the ratchet wheel 36 becomes effective to bias the code wheel assembly 38 in a counterclockwise direction to the home, null, or start position, at which the arm 340 engages the stop 342 and the arm 360 is positioned out of engaging relation with the reset arm 362.

As the code wheel assembly 38 returns to the home, null, or start position, the pin 350 actuates an arm portion 430 of the latch 352 so as to pivot the latch 352 about the pin 417 in a counterclockwise direction permitting the reset lever 382 to return the pawl lift or pick-up device 102 to a releasing condition.

Moreover, as the pick-up device 102 returns to the releasing condition, arm 382 moves in a clockwise direction about shaft 385 while pawl 392 is carried by the arm 382 in disengaging relation to the ratchet wheel 390 and without imparting arcuate movement to the gear 403 so that the switch mechanism 407 remains in a ground circuit open position.

In order to close the switch mechanism 407, a solenoid 492 having plunger 494 connected at 498 may be energized so as to actuate the arm 382 in a counterclockwise direction about the shaft 385, whereupon the pawl 392 once again engages a tooth of the ratchet wheel 390 connected to shaft 385 to arcuately actuate the gear 403 controlling switch button 405 of switch mechanism 407 so as to close the switch mechanism 407 and thereby the ground circuit for the actuating solenoids 146 and 232. Upon de-energization of the solenoid 492, the plunger 494 is biased upward by the spring 495, shown in FIG. 5, to actuate arm 382 in a clockwise direction about the shaft 385 so that the pawl 392 moves freely on the ratchet wheel 390 so as to permit the switch mechanism 407 to remain in the circuit closed position whereupon the decoding mechanism is in condition for reoperation.

Upon a proper decoding message being received by the decoder, the locking posts 260 are selectively actuated so as to unlock the inner wheel element 48 from the outer wheel elements 40 and 42 and permit free angular movement of the outer wheel elements 40 and 42 relative to the inner wheel element 48 upon the completion of the decoding message whereupon the arm 360 of the inner wheel element 48 operatively engages the arm 362. In the latter case, the biasing force asserted by the spring 365 on the arm 362 is sufficient to hold the arm 360 against the resilient force applied through the light coupling spring 50 to the inner wheel element 48 by the angular movement of the outer wheel elements 40 and 42 relative to inner wheel element 48.

The selective actuation of the solenoids 146 and 232 to provide the required decoding message to effect the unlocking action of the outer wheel elements 40 and 42 relative to the inner wheel element 48 may be provided by the selective operation of control switches 450 and 452 controlling energizing circuits from a battery 454 for the respective solenoids 146 and 232, as shown in FIG. 1, or by other suitable control mechanism.

Figure 6:
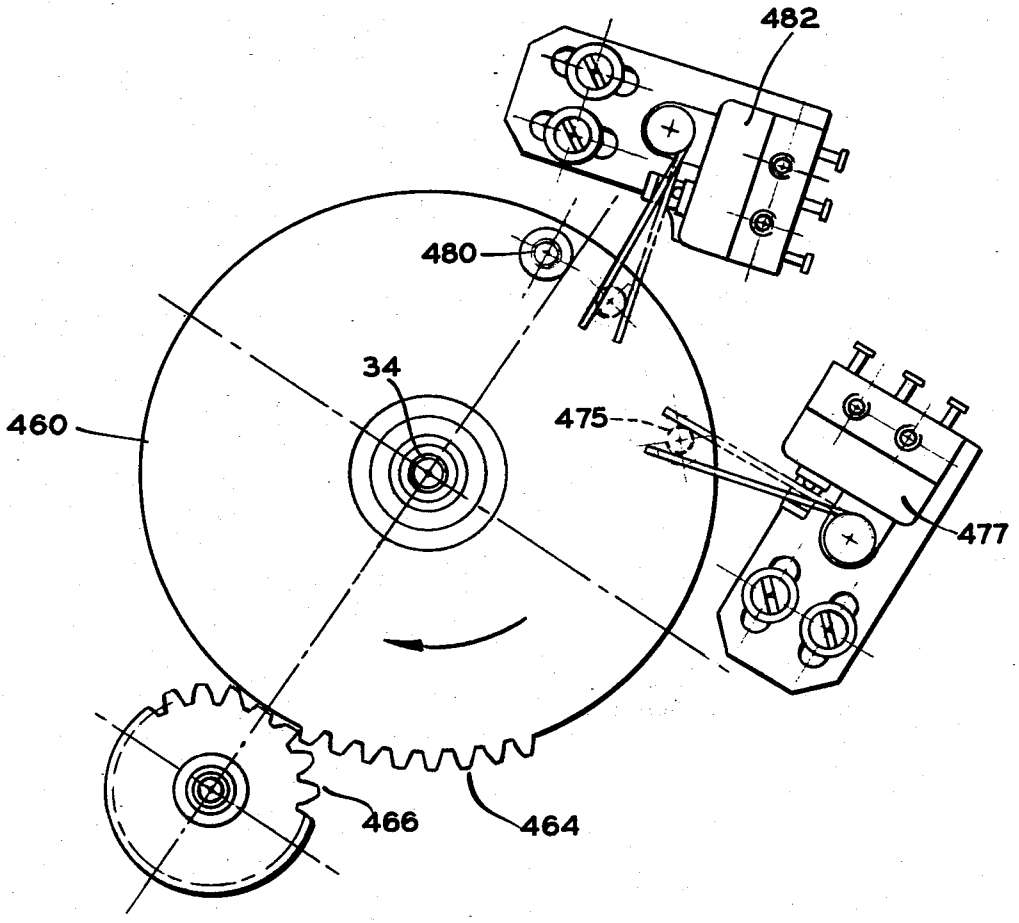
FIG. 6 is an enlarged fragmentary end view of the switch actuating mechanism of FIG. 2 taken along the lines 6—6 and looking in the direction of the arrows.

Upon the outer wheel elements 40 and 42 being unlocked from the inner wheel element 48, the further angular adjustment of the outer wheel elements 40 and 42 relative to the inner wheel element 48 through the pawl actuating mechanisms 80 and 82 causes the shaft 34 to be angularly adjusted so as to in turn position a control disc 460 for operating a control switch 462 for initiating firing or operation of a controlled object. The control disc 460 includes a gear portion 464 arranged for tooth engagement during the last operation with a pinion gear 466, shown in FIGS. 1 and 6, to operatively perform a desired switching or other suitable function.

A fixed stop 468 may be provided having a portion 469 cooperating with a member 471 affixed to the pinion gear 466 and further locked by a projection on the bottom of a pivotal device 473 so as to prevent the controlled switch 462 from being inadvertently placed in a closed or firing position. Concurrently with the meshing of teeth 464 with 466 the pin 480 rotates the pivotal device 473 away from engagement with 471 so as to permit closing of switch 462.

The control disc 460 affixed to the shaft 34 also includes a pin 475 for actuating a suitable switch mechanism 477 for closing a circuit from a battery 408 to a lamp 479 or other suitable means to indicate a firing position of the control switch 462.

There is further provided on the control disc 460, the pin 480 which is also arranged to actuate a suitable control switch 482 for closing a circuit from the battery 408 to a lamp 485 or other suitable indicator means upon the code wheel assembly 38 being returned to a start, home, or null position by the pickup of the pawl actuating mechanisms 80 and 82 through the operation of the device 102, as heretofore explained.

Moreover, to effect the latter operation of the decoding wheel assembly 38, there is also provided a switch 490 or other suitable means for controlling the circuit from the battery 454 for effecting energization of a solenoid 492. Energization of the solenoid 492 is effective to operatively position downwardly an actuating rod or plunger 494 which, as shown in FIGS. 1 and 7, is operably connected by a pin 496 at a point 498 on the reset lever 382 so as to pivot the lever 382 upon energization of the solenoid 492 about the shaft 385 in a counterclockwise direction so as to in turn actuate the pick-up device 102 in an upward direction to effect the pickup of the pawls 100 and 200 and render the code wheel assembly 38 effective to return in a counterclockwise direction to the start, null, or home position under the biasing force of the spring 70.

In effecting the last-mentioned pick-up action, the device 102 includes a rod 500 connected by a bolt 502 to the reset lever 382 at point 504. Further, secured at the opposite end of the rod 500 is a pick-up member having portions 506 and 508 arranged to engage the end portions 100 and 200, respectively, of the pawls 90 and 190 so as to raise the same from the ratchet wheel 36.

The pick-up device also includes a step portion 510 so arranged as to engage the arm 340 projecting from the reset wheel 56 upon the code wheel assembly 38 being driven in a counterclockwise direction by the spring 70 so as to actuate the reset wheel 56 in a clockwise sense, as viewed in FIG. 3, relative to the outer wheel element 40, upon the arm 340 approaching the home position. Thereafter, the pin 350 carried by outer wheel 40 actuates the latching mechanism 352 so as to permit the pick-up device 102 to release the pawls 90 and 190. The actuation of the reset wheel 56 in a clockwise sense relative to the code wheel assembly 38 causes the end portions 327 of the locking detents 316 to be positioned by the reset portions 330 of the reset wheel 56 so as to release the code posts 260 under the biasing forces of the spring elements 275 and 277 whereupon the code posts 260 may be returned to the neutral position shown in FIG. 8.

The pin 335 projecting from the reset disc 56 is also arranged in cooperative relation in a slot 337 in the outer wheel element 40 so as to limit the angular adjustment of the reset disc 56 relative to the outer wheel element 40. The reset disc 56 is freely mounted on the shaft 34 and normally follows the adjustment of the outer wheel element 40 within the limits of the slot 337 through the coupling action of the spring 58 so that the locking detent members 316 under the biasing force of the springs 320 are rendered effective to lock the code posts 360 in one or the other of the adjusted positions thereof, as shown by FIGS. 9 and 10, upon the selective actuation thereof by the knocker arms 150 and 236, respectively.

However, upon the pick-up device 102 being actuated upwardly, step portion 510 thereof is positioned so as to limit the arm 340 of the reset disc 56 and to permit wheel elements 40 and 42 to override wheel 56 as the same move in a counterclockwise direction in approaching the home position under the biasing force of spring 70 so as to release the several detent members 316, as heretofore explained. Furthermore, upon return of the code wheel assembly 38 to the start, home, or null position, and after the pick-up device 102 has released the pawls 90 and 190 and removed the step portion 510 from the limiting action on the arm 340, the arm 340 of the reset mechanism 56 then engages the stop 342 at the home, start, or null position of the code wheel assembly 38.

Operation

The electromechanical decoder of the present invention is a device which requires an input of a special digital code to obtain a desired end function, in this case, closure of the control switch 462. Successful operation requires a sequential or serial input of a digital code which matches a code previously set in the unit. Sending the unit an improper code results in an automatic return to a home position of the code wheel assembly 38 upon completion of the code input instead of closure of the control switch 462. The unit may, of course, be arranged to operate without an automatic return.

Code Wheel Operation

In the device disclosed herein, the code is set in the code wheel assembly 38 by a preadjustment of a plurality of code posts 260 (in the illustrated device, 18 code posts may, for example, be provided, but the number thereof may be varied as may be required). These code posts 260 are placed near the periphery of the outer code wheel elements 40 and 42. The code wheel assembly 38 is driven by a set of two solenoids 146 and 232, one solenoid 232 being designated for code purposes as "mark" and the other solenoid 146 being designated "space".

The inner wheel element 48 is mounted concentric with the main shaft 34 and is free to rotate in relation to it. The inner wheel element 48 is located relative to and locked together with the outer wheel elements 40 and 42 via the code post 260. The inner wheel element 48 is prevented from rotating beyond the 17th position by a protruding arm 360 which operatively engages the arm 362 at that point.

Following a correct message, when the inner wheel element 48 is displaced relative to the outer wheel elements 40 and 42, proper wheel alignment upon return is obtained by a light spring 50 preloaded between the outer and inner wheel elements. The action of the mechanism described herein provides for a serial-input parallel readout characteristic. This approach yields no information on whether any bit being inserted is correct or not until the 18th bit advance motion is attempted. Only at this point, with the inner wheel element 48 at its stop point engaging the arm 362, will the code input be in effect sampled for accuracy. If all the code bit inputs have been proper, the inner wheel element 48 and outer wheel elements 40 and 42 will be disengaged after the 18th bit input, and the outer wheel elements 40 and 42 will be permitted to advance to closure of the control switch 462 through operation of the shaft 34. Should any or all code bits be incorrect, the inner and outer wheel elements will not disengage and the stopping of the inner wheel element 48 by arm 360 engaging arm 362 will also prevent the outer wheel elements from further motion other than that required for the automatic reset operation.

The motion required for actuation of the automatic reset mode effected through actuation of the arm 362 and resulting operation of the pick-up device 102 may be, for example, 5° of wheel travel as compared to 18° of wheel travel between each code post position.

Code Posts

Code posts 260 are preset prior to unit closure to represent a series of digital 1 or 0 bits. Each code post 260 is set for either a 1 or 0 bit merely by rotating it to either of two positions, each 180° away from the other. They are held in position by the spring loaded ball detents 307.

FIGS. 9 and 10 show how the code posts 260 may be operated so as to discern between a proper and an improper bit. Assuming the code post 260 is set for "mark" operation, pulsing the mark solenoid 232 will move the code post 260 in the proper direction, as shown in FIG. 9 to place the post cutout 264 directly over the inner wheel 48. That particular code post 260 thus will no longer contribute to the locking action of the inner wheel element 48 to the outer wheel elements 40–42. If, however, the space solenoid 146 is pulsed at that same position of the code wheel assembly 38, the code post cutout portion 264 is moved further away, as shown in FIG. 10, and the code post 260 remains a contributor to the locking action effected thereby between the two wheels.

Solenoid Electrical and Audible Noise Masking

The code input information, irrespective of whether each code post 260 has been properly actuated to allow closure of the switch 262 will be stored until the advancing motion of the outer wheel elements 40 and 42 after the 18th bit input is attempted. It can be seen, therefore, that the amount of work expended to move any code post 260 is nominally the same whether actuated by the "mark" or "space" solenoids 232 and 146, respectively. That is to say, the orientation or coding of the code post 260 has no effect on the effort involved in the displacement thereof during decoding, whether a correct or incorrect decoding bit is applied.

In this fashion, the electrical emanation of the solenoids 146 and 232 while not actually masked or eliminated, have no effect on the security problem when considering it in relation to code deduction possibilities. By the same token, since whatever audible noise generated during decoding is always the same for each position of the code posts 260 monitoring the audible noise also yields no code deduction information.

Decoding Operation

In performing a decoding operation, the following sequences of operation take place:

a. Advancing or Stepping of Code Wheel Assembly

Solenoid (146 or 232) retracts plunger upon application of power and thereby:

1. Advances pawl (90 or 190) to next position on ratchet wheel 36.
2. Stores energy in code wheel advance spring (126 or 226).
3. Pushes code post 260 through operation of bell crank actuator (150 or 236).

Upon removal of power from the solenoid (146 or 232):

1. Code wheel advance spring (126 or 226) advances code wheel assembly 38 through action of pawl (90 or 190) on ratchet wheel 36.
2. Detent leaf spring 106 is placed in contact with pawl operating mechanism (84 and 184) to prevent inadvertent or unprogrammed advance to code wheel assembly 38.
3. Energy is stored in code wheel return spring 70.

The code wheel assembly 38, while progressing from the first to the 18th bit positions will advance at each actuation whether the code bit inserted is correct or not.

When the 17th position or station of the code wheel assembly 38 has been reached, the inner and outer wheels are still "together".

If the code input has been correct:

1. The inner and outer wheels elements 48 and 40–42 still maintain the same position relative to each other.
2. No code posts 260 are engaged in grooves 266 of the inner wheel element 48 and the outer wheel elements 40–42 are mechanically free of the inner wheel element 48.
3. The arm 360 of the inner wheel element 48 is normally against the stop or arm 362.
4. No motion of the control switch 462 has taken place, however, the gear portion 464 of the control disc 460 is now in position to initiate actuation of the control switch 462.
5. The outer wheel elements 40 and 42 are now in condition for further advance through solenoid operation to effect actuation of the control switch 462.

If the code input has not been correct:

1. The inner wheel element 48 and the outer wheel elements 40–42 maintain their relative positions to each other in steps 1–17.
2. Any number of code posts 260 are still engaged in the grooves 266 of the inner wheel element 48.
3. The arm 360 of the inner wheel element 48 is normally against the stop or arm 362.
4. No motion of control switch 462 has taken place.
5. The outer wheel elements 40 and 42 are locked against further advance. End output actuation cannot take place.
6. 18th bit input will cause the wheel assembly 38 to return automatically to home position by the arm 360 actuating the reset mechanism arm 362.

b. Switch actuation

Assuming correct code input, the code sheel assembly 38 will advance on the 18th bit actuation to effect the following sequency of operation.

1. The gear teeth portion 464 of control disc 460 mesh with switch pinion 466 to rotate switch 462 to a circuit closing position for effecting firing operation of the missle or controlled object.

Reset Modes

Once the code wheel assembly 38 is moved off the safe or home position, a mechanism is provided to return it to the home position.

In the illustrated electromechanical decoder, reset of the mechanism to the home position is accomplished by the device 102 lifting the two driver pawls (90 and 190) from the ratchet 36 allowing the energy stored in the wheel return spring 70 to rotate the code wheel assembly 38 to the safe, null, or home position. The initiation of the action is accomplished by either of two means. The first means utilizes an external electrical signal to the command reset solenoid 492 to lift the pawls 90 and 190, with the code wheel assembly 38 anywhere from the second position to the last or 18th position. Upon receipt of an improper message, the second means effects an automatic reset through an internal mechanical linkage powered by the stepping springs (126 or 226)

which acts through the engaging arms 360–362 and the pick-up device 102 to lift the pawls 90 and 190 from the ratchet wheel 36 for effecting return of the wheel assembly 38 under the biasing force of spring 70 upon completion of an improper message.

The driver solenoid circuit through operation of switch 407 is opened every time a reset of the code wheel assembly 38 occurs following a code message input whether through the command solenoid 492 or automatic reset means. In this condition access to the driver solenoids (146 and 232) is denied until the command reset solenoid 492 is pulsed so as to close the solenoid circuits through switch 407, as heretofore explained.

Under normal conditions a command reset pulse precedes the code message, therefore, a mechanism operation will follow after reset if the unit is in the home position. Should the unit be in some intermediate position, a message would simply cause the unit to return home on the basis of the initial command reset pulse applied to the solenoid 492 so that energization of the driver solenoid (164 or 232) cannot be effected until the reset solenoid 492 has been pulsed once again.

The electromechanical decoder may be so designed with respect to size and weight as to be carried by an aircraft, missile or warhead and the control switch 462 may be arranged so as to control the firing of the missile or projectile borne thereby, while the switches 450, 452, and 490 may be controlled through a telemetering link, computer, or control system of a suitable type, not shown.

Although only one embodiment of the invention has been illustrated and described, various changes in the form and relative arrangements of the parts which will now appear to those skilled in the art may be made without departing from the scope of the invention. Reference is, therefore, to be had to the appended claims for a definition of the limits of the invention.

What is claimed is:

1. An electromagnetic decoder comprising a code wheel assembly including a base member, a shaft supported by the base member, a first wheel element and a second wheel element carried by the shaft, a plurality of code posts carried by the first wheel element and preset for locking the first and second wheel elements together in driving relation, selectively operable means carried by the base member for actuating the code posts sequentially in a predetermined sense for unlocking the first and second wheel elements, and means actuated by one of the wheel elements for performing a control function upon the first wheel element being unlocked from the second wheel element.

2. The combination defined by claim 1 in which the code posts include generally cylindrical pins having indent portions along the periphery thereof arranged to be selectively adjusted angularly in relation to the second wheel element so as to change the predetermined senses of actuation for effecting the unlocking of the first and second wheel elements.

3. The combination defined by claim 1 in which each of said code posts include generally cylindrical pins having indent portions positioned therein along the periphery and intermediate opposite ends thereof and arranged in spaced relation so that each of the code posts may be angularly preset to bring the indent portions selectively into operative relation with one of said wheel elements so as to unlock said one wheel element from the other wheel element upon longitudinal actuation of the code posts in a predetermined sense and to retain the one wheel element in locking relation with the other wheel element upon longitudinal actuation of the code posts in any other sense.

4. An electromechanical decoder comprising a rotatable wheel assembly including a base member, a shaft supported by the base member, a first wheel element and a second wheel element carried by the shaft, a plurality of code posts slideably mounted in the first wheel element for locking the second wheel element to the first wheel element, motor means for selectively actuating each of the code posts in locking and unlocking senses, and other means conditioned by operation of said motor means for effecting a step actuation of the code wheel assembly upon completion of the selective actuation of each code post.

5. An electromechanical decoder comprising a rotatable code wheel assembly including a base member, a shaft supported by the base member, a first wheel element carried by the shaft and a second wheel element, a plurality of code posts for locking the second wheel element to the first wheel element in driving relation, a pair of actuating members carried by the base member and positioned at opposite ends of the code posts for selectively operating the code posts in opposite senses, said code posts including preset angularly adjustable means for unlocking the second wheel element from the first wheel element dependent upon the selected sense of longitudinal actuation of the code posts by said actuating members, and means operably connected to the first wheel element for effecting a control function upon the first wheel element being unlocked from the second wheel element upon completion of a predetermined decoding sequence of operation of said actuating members.

6. The combination defined by claim 5 in which the second wheel element includes biasing means operatively connected between the base member and the first wheel element for returning the code wheel assembly to a start position upon the decoding sequence of operation failing to unlock the second wheel element from the first wheel element.

7. The combination defined by claim 5 including ratchet means mounted on the shaft, pawl means angularly positioned on the shaft relative to the ratchet means in an operative relation thereto, said pawl means being operatively connected to the selectively operable actuating members to step actuate the code wheel assembly so as to selectively position the code posts for actuation by said selectively operable actuating members.

8. The combination defined by claim 7 including spring means operatively connected between the base member and the first wheel element and energized by the stepping action of the code wheel assembly, means for lifting the pawl means out of operative relation with the ratchet means for effecting a return adjustment of the code wheel assembly by the spring means to a start position, and selectively operable means to actuate the pawl lifting means for rendering the spring means effective for biasing the code wheel assembly to the start position.

9. The combination defined by claim 7 including spring means operatively connected between the base member and the first wheel element and energized by the stepping action of the code wheel assembly, control means for rendering the spring means effective for returning the code wheel assembly to a start position, and means carried by said second wheel element for actuating said control means upon the decoding sequence of operation being ineffective to unlock the second wheel element from the first wheel element.

10. An electromechanical decoder comprising a base member, a shaft supported by the base member, a code wheel assembly including an inner wheel element and an outer wheel element carried by the shaft, a ratchet wheel mounted on the shaft and operatively connected to the code wheel assembly, a pair of actuating pawls angularly positioned on the shaft relative to the ratchet wheel and cooperating therewith for rotatably positioning the code wheel assembly in a step action, a pair of solenoids selectively operable for actuating each of said pawls relative to said ratchet wheel, a spring conditioned by the operation of each solenoid and effective to cause each pawl to step actuate the ratchet wheel and thereby the code wheel assembly to a second adjusted position under the biasing force of said spring upon de-energization of the selectively operated solenoid, the other pawl being arranged to maintain the ratchet wheel and thereby the code wheel assembly in a fixed position until the de-energization of the selectively operated solenoid renders the spring effective, means for locking the inner wheel element to the outer wheel element in driving relation, means selectively operable by the solenoids for actuating said locking means in locking and unlocking senses dependent upon the selection of the actuating means, and means operable by the outer wheel element for effecting a control function upon the outer wheel element being unlocked from the inner wheel element.

11. An electromechanical decoder comprising a base member, a shaft supported by the base member, a code wheel assembly including an inner wheel element and an outer wheel element carried by the shaft, a ratchet wheel mounted on the shaft and operatively connected to the code wheel assembly, a pair of actuating pawls angularly positioned on the shaft relative to the ratchet wheel and cooperating therewith for rotatably positioning the code wheel assembly in a step action, a pair of solenoids selectively operable for actuating each of said pawls relative to said ratchet wheel, a spring conditioned by the operation of each solenoid and effective to cause each pawl to step actuate the ratchet wheel and thereby the code wheel assembly to a second adjusted position under the biasing force of said spring upon de-energization of the selectively operated solenoid, the other pawl being arranged to maintain the ratchet wheel and thereby the code wheel assembly in a fixed position until the de-energization of the selectively operated solenoid renders the spring effective, means for locking the inner wheel element to the outer wheel element in driving relation, means selectively operable by the solenoids for actuating said locking means in locking and unlocking senses dependent upon the selection of the actuating means, means operable by the inner wheel element upon the inner wheel element being retained in said locking relation with the outer wheel element on completion of a decoding sequence of operation, said last-mentioned means being rendered effective by said inner wheel element for lifting the pair of actuating pawls from operative relation to the ratchet wheel, and spring means energized by the adjustment of the code wheel assembly by the ratchet wheel and actuating pawls for returning the code wheel assembly to a predetermined starting position.

12. For use with a pair of electrical circuits that may be energized one circuit at a time in any sequential order, apparatus for determining if said circuits are energized in a predetermined order, said apparatus comprising a base member, a shaft supported by the base member, a code wheel supported by the shaft and including actuatable means for storing said predetermined order therein, means defining a start position for said code wheel, spring means for biasing said code wheel toward said start position, a ratchet wheel carried by said shaft and drivingly connected to said code wheel, pawl means, motor means electrically operated by said circuits for operating said pawl means, said pawl means being normally in an operative relation with said ratchet wheel for rotating said ratchet wheel and said code wheel in a direction opposed to said spring means, means selectively operated by said motor means for actuating said storing means is said code wheel, and means operable by said code wheel for effecting a control function upon the actuation of said storing means being in said predetermined order.

13. The combination defined by claim 12 including other means operable by said code wheel upon the actuation of said storing means being in an order other than said predetermined order, and said other means including means for rendering said spring means effective to bias said code wheel to said start position.

14. The combination defined by claim 12 including other means operable by said code wheel upon the actuation of said storing means being in an order other than said predetermined order, said other means including means for lifting said pawl means from operative relation with said ratchet wheel whereupon said code wheel may be biased by said spring means to said start position.

15. The combination defined by claim 12 including operator-operative means for lifting said pawl means from operative relation with said ratchet wheel whereupon said code wheel may be biased by said spring means to said start position.

16. The comvination defined by claim 12 in which the storing means in said code wheel includes a plurality of code posts selectively operable by said selectively operated actuating means.

17. The combination defined by claim 12 in which the storing means in said code wheel includes a plurality of code posts operable by said selectively operated actuating means, and said code posts including adjustable means whereby said code posts may be initially set for said predetermined order of actuation.

18. An electromagnetic decoder comprising a code wheel assembly including a first wheel element and a second wheel element, a plurality of code posts preset for locking the first and second wheel elements in driving relation, selectively operable means for longitudinally actuating the code posts sequentially in opposite senses, means for releasably locking the code posts in the longitudinally actuated senses, said code posts being effective for unlocking the first and second wheel elements upon completion of the actuation thereof in a predetermined order and sense, and means actuated by one of the wheel elements for performing a control function upon the first wheel element being unlocked from the second wheel element.

19. An electromechanical decoder comprising a code wheel assembly including a base member, a shaft supported by the base member, a first wheel element carried by the shaft and a second wheel element, carried by the shaft a plurality of code posts carried by the first wheel element and preset for locking the first and second wheel elements together in driving relation, selectively operable members carried by the base member and positioned at opposite ends of the code posts for longitudinally actuating the code posts sequentially and selectively in opposite senses, driving means carried by the base member to step actuate the first wheel element and thereby the second wheel element locked thereto so as to sequentially position the code posts for actuation by said selectively operable actuating members, means carried by the first wheel assembly for releasably locking the code posts in the actuated sense, said code posts including locking and unlocking portions and being effective for unlocking the first and second wheel elements upon completion of the actuation of the code posts in a predetermined order and sense, control means operatively positioned so as to raise said step actuating means out of operative relation with said first wheel element, means for biasing said code wheel assembly to a start position, said control means being actuated by said second wheel element upon completion of the actuation of said code posts in an order and sense other than as so predetermined so as to raise said step actuating means out of operative relation with said first wheel element and thereby render said biasing means effective to return the code wheel assembly to the start position, reset means for releasing said code post locking means, and said reset means being operable by the control means upon the code wheel assembly approaching the start position under the force of said biasing means.

20. The combination defined by claim 19 in which said reset means includes a disc concentrically mounted on the shaft relative to the code wheel assembly, and said locking means including pivotal members carried by the first wheel element for releasably locking the code posts in the longitudinally actuated senses, said disc having peripheral indent portions therein cooperating with said locking members, a spring drivingly coupling the disc to the first wheel element, and the disc having an arm operable by the control means for angularly moving the disc relative to the first wheel element to actuate the locking members so as to release the code posts upon the code wheel assembly approaching the start position under the force of said biasing means.

21. The combination defined by claim 20 including a releasable latching mechanism for holding the control means in said operative position, and means carried by the first wheel element and operable for actuating said latching mechanism so as to release the control means after the reset means has been operated by said control means to release the code post locking means.

22. An electromechanical decoder comprising a code wheel assembly including a base member, a shaft supported by the base member, a first wheel element carried by the shaft and a second wheel element, carried by the shaft the shaft being drivingly connected to the first wheel element, a plurality of code posts carried by the first wheel element and preset for locking the first and second wheel elements in driving relation, a spring for coupling the first wheel element to the second wheel element, selectively operable means for longitudinally actuating the code posts sequentially in opposite senses, a ratchet wheel carried by said shaft and operatively connected to said shaft, pawl means angularly positioned on the shaft in cooperative relation to the ratchet wheel, said pawl means being operated by said selectively operable means for rotating said ratchet wheel so as to position said code wheel assembly for said sequential actuation of the code posts, means for releasably locking the code posts in the longitudinally actuated senses, said code posts being effective for unlocking the first and second wheel elements upon completion of the actuation of said code posts in a predetermined order and sense, means for limiting the angular movement of the second wheel element relative to the first wheel element upon the completion of the actuation of said code posts in said predetermined order and sense, and control means operable by the shaft upon angular movement of said first wheel element relative to said second wheel element upon the first wheel element being unlocked from the second wheel element by the actuation of said code posts in said predetermined order and sense.

23. An electromechanical decoder comprising a code wheel assembly including a base member, a shaft supported by the base member, a first wheel element and a second wheel element carried by the shaft, the shaft being drivingly connected to the first wheel element, a plurality of code posts carried by said first wheel element and preset for locking the first and second wheel elements in driving relation, a spring for coupling the first wheel element to the second wheel element, selectively operable means for longitudinally actuating the code posts sequentially in opposite senses, a ratchet wheel carried by the said shaft and operatively connected to said shaft, pawl means angularly positioned on the shaft in cooperative relation to the ratchet wheel, said pawl means being operated by said selectively operable means for rotating said ratchet wheel so as to position said code wheel assembly for said sequential actuation of the code posts, means for releasably locking the code posts in the longitudinally actuated senses, said code posts being effective for unlocking the first and second wheel elements upon completion of the actuation of said code posts in a predetermined order and sense, means for limiting the angular movement of the second wheel element relative to the first wheel element upon the completion of the actuation of said code posts in said predetermined order and sense, control means operable by the shaft upon angular movement of said first wheel element relative to said second wheel element upon the first wheel element being unlocked from the second wheel element, said code posts being effective for retaining the first and second wheel elements in a locked relation upon completion of actuation of said code posts in an order and sense other than as predetermined so as to prevent operation of said control means by said shaft, means actuated by said limiting means for lifting said pawl means from operative relation with said ratchet wheel upon the first wheel element being retained in a locked relation with the second wheel element, and spring means being effective upon the lifting of the pawl means for returning the code wheel assembly and shaft to a start position.

24. The combination defined by claim 23 including reset means for releasing the code post locking means, and said reset means being operable by the pawl lifting means upon the code wheel assembly being returned to said start position by said spring means.

25. For use with a pair of electrical circuits that may be energized one circuit at a time and in any sequential order, apparatus for determining if such circuits are energized in a predetermined order, the apparatus comprising a base member, a shaft supported by the base member, a code wheel assembly having means for storing said predetermined order therein including a plurality of code posts, said code posts including angularly adjustable means for setting the predetermined order, means electrically operated by said circuits for longitudinally actuating said code posts in said code wheel assembly, and means operable by said code wheel assembly for effecting a control function upon the longitudinal actuation of said code posts being in the predetermined order set by the angularly adjustable means of said code posts.

26. For use with a pair of electrical circuits which may be energized one circuit at a time in any sequential order, an apparatus for determining if such circuits are energized in a predtermined order, the apparatus comprising a base member, a shaft supported by the base member, a first wheel element supported by the shaft, the shaft drivingly connected to the first wheel element, stop means defining a start position for said first wheel element, a first spring for biasing said first wheel element toward said start position, a second wheel element angularly movable on said shaft, a second spring for drivingly coupling the first wheel element to the second wheel element, a plurality of code posts slidably mounted in said first wheel element and having opposite end portions projecting from ends of the first wheel element, said code posts including locking and unlocking portions and being preset for locking the first and second wheel elements in direct driving relation, each of said code posts including a locking peripheral raised portion arranged in a locking relation between the first and second wheel elements and an unlocking indent portion positioned therein intermediate opposite ends of each of said code posts, said indent portion being arranged in each of said code posts so as to cooperate with said second wheel element upon longitudinal actuation of the code post in a predetermined sense so as to disconnected the second wheel element from locking relation with the first wheel element, and each of said code posts being so arranged that upon longitudinal actuation thereof in an opposite sense the locking peripheral raised portion of the code post remains in a locking relation between the first and second wheel elements, said first wheel element including resilient means for biasing each of the code posts to the preset locking relation between the first and second wheel elements, a first knocker arm supported by the base member and operatively mounted at one end of the first wheel element for sequentially actuating end portions of the code posts projecting therefrom in one sense, a second knocker arm supported by the base member operatively positioned at the other end of the first wheel element for sequentially actuating other end portions of the code posts projecting therefrom in an opposite sense, a first solenoid supported by the base member first linkage means operatively connecting the first solenoid with the first knocker arm, a second solenoid supported by the base member, second linkage means operatively connecting the second solenoid to the second knocker arm, said solenoids being selectively energized by the aforesaid pair of electrical circuits, a ratchet wheel carried by said shaft and operatively connected to said shaft, a first pawl angularly positioned on the shaft and arranged in operative relation to said ratchet wheel, a second pawl angularly positioned on the shaft and arranged in operative relation with said ratchet wheel, third linkage means operatively connecting said first pawl to said first solenoid, fourth linkage means operatively connecting said second pawl to said second solenoid, said first pawl being actuated upon energization of the first solenoid to a position for effecting operation of the ratchet wheel, a third spring operatively connected to the third linkage means and acting in opposition to the force of the first solenoid for actuating the first pawl from said operative position in a sense for rotating said ratchet wheel upon de-energization of the first solenoid so as to step actuate said first wheel element in opposition to said first spring to a position for selective actuation of the next succeeding code post by said knocker arms, said second pawl being actuated upon energization of the second solenoid to a position for effecting operation of the ratchet wheel, a fourth spring operatively connected to the fourth linkage means and acting in opposition to the force of the second solenoid for actuating the second pawl from said operative position in a sense for rotating said ratchet wheel upon de-energization of the second solenoid so as to step actuate said first wheel element in opposition to said first spring to a position for selective actuation of the next succeeding code post by said knocker arms, pivotal members carried by the first wheel element for releasably locking the code posts in an actuated sense, a reset disc angularly movable on the shaft relative to the first wheel element, said reset disc having peripheral indent portions therein cooperating with said locking members, a fifth spring drivingly coupling the reset disc to the first wheel element, the indent portions of said code posts being effective for unlocking the first and second wheel elements upon completion of the selective actuation of said code posts by said knocker arms in a predetermined order and sense, a pivotally mounted first limiting arm, said second wheel element having a projecting second arm arranged to engage said first limiting arm, a sixth spring holding said first limiting arm in engaging relation with said second arm for limiting the angular movement of the second wheel element against the biasing force of the second coupling spring upon the completion of the actuation of said anode post in said predetermined order and sense, a control switch, means operable by the shaft for operating said control switch upon angular movement of the first wheel element relative to said limited second wheel element upon the first wheel element being unlocked from the second wheel element by the completion of the actuation of said code posts in said predetermined order and sense, said code posts being effective for retaining the first and second wheel elements in a locked relation upon completion of the actuation of said code posts by said knocker arms in an order and sense other than as predetermined, a pick-up device for lifting said first and second pawls out of operative relation with said ratchet wheel, linkage means operatively connecting said pivotally mounted first limiting arm to said pick-up device for rendering said pick-up device effective for lifting the first and second pawls out of operative relation with said ratchet wheel upon the first wheel element being retained by said code posts in said locked relation with the second wheel element whereupon the second arm of the second wheel element may actuate said first limiting arm against the biasing force of the sixth spring and under the biasing force of one of said third and fourth pawl actuating springs, each of said third and fourth pawl actuating springs applying a greater force than said sixth spring, said first spring being thereupon rendered effective upon the lifting of the first and second pawls by said pick-up device out of operative relation with said ratchet wheel for returning the first wheel element to the start position defined by said stop means, the reset disc including an arm operable by the pick-up device in the pawl pick-up position for angularly moving the disc relative to the first wheel element to actuate the locking members so as to release the code posts upon the first wheel element approaching the start position under the biasing force of said first spring, a latching device for holding the pick-up device in said pawl pick-up position, and a member carried by the first wheel element and operable for actuating said latching device so as to release the pick-up device from the pawl pick-up position after the reset disc has been angularly positioned by said pick-up device so as to cause the locking members to release the code posts.

27. The combination defined by claim 26 including independent operator-operative means for actuating the pick-up device to the pawl pick-up position so as to effect the return of said first wheel element to the start position by said first spring.

28. The combination comprising a base member, a shaft supported by the base member, a first wheel element supported by the shaft, the shaft drivingly connected to the first wheel element, stop means defining a start position for said first wheel element, a first spring for biasing said first wheel element toward said start position, a second wheel element supported by the shaft and angularly movable on said shaft, a second spring for drivingly coupling the first wheel element to the second wheel element, releasable locking means for directly connecting the first wheel element to the second wheel element, a ratchet wheel supported by the shaft and operatively connected to said shaft, a pawl angularly positioned on the shaft and normally in an operative relation with said ratchet wheel, a pick-up device for lifting the pawl out of said operative relation with the ratchet wheel, a solenoid, means operatively connected said solenoid to said pawl for positioning said pawl into a driving relation with said ratchet wheel upon energization of said solenoid, a third spring operatively connected to said pawl for acting in opposition to said solenoid upon energization thereof said effective upon de-energization of said solenoid for actuating said pawl in said driving relation with said ratchet wheel so as to angularly position the shaft in a direction opposed to said first spring, means for limiting angular movement of the second wheel element at a first predetermined adjusted position of the second wheel element whereupon the first wheel element may be angularly movable relative to the second wheel element upon the locking means releasing the second wheel element from the locking relation with the first wheel element, control means operable by the shaft upon said angular movement of the first wheel element relative to the second wheel element, said limiting means including an arm, a fourth spring for biasing the arm into limiting relation with the second wheel element, linkage means operatively connecting said limiting arm to said pick-up device for positioning said pick-up device so as to be effective to lift the pawl out of operative relation with said ratchet wheel at a second predetermined adjusted position of the second wheel element and upon the first wheel element being retained by said locking means in a locked relation with the second wheel element, said limiting arm being actuated by said second wheel element against the biasing force of the fourth spring and under the biasing force of said pawl actuating third spring, and said first spring being thereupon rendered effective upon the lifting of the pawl by said pick-up device out of said operative relation with said ratchet wheel for returning the first wheel element to the start position defined by said stop means.

* * * * *